US009534370B2

(12) United States Patent
Kokoschka et al.

(10) Patent No.: US 9,534,370 B2
(45) Date of Patent: Jan. 3, 2017

(54) ASSEMBLY COMPRISING AN ENGINE

(71) Applicant: Caterpillar Energy Solutions GmbH, Mannheim (DE)

(72) Inventors: Benno Kokoschka, Karlsruhe (DE); Abdulkadir Secgin, Mannheim (DE); Heinrich Baas, Worms (DE)

(73) Assignee: Caterpillar Energy Solutions GmbH, Mannheim (DE)

( * ) Notice: Subject to any disclaimer, the term of this patent is extended or adjusted under 35 U.S.C. 154(b) by 1 day.

(21) Appl. No.: 14/629,146

(22) Filed: Feb. 23, 2015

(65) Prior Publication Data

US 2015/0240474 A1 Aug. 27, 2015

(30) Foreign Application Priority Data

Feb. 24, 2014 (EP) ..... 14000636

(51) Int. Cl.

| | |
|---|---|
| ***E04B 1/34*** | (2006.01) |
| ***E04B 1/343*** | (2006.01) |
| ***E04H 1/12*** | (2006.01) |
| ***B65D 88/02*** | (2006.01) |
| ***B65D 88/12*** | (2006.01) |
| ***F01N 3/02*** | (2006.01) |
| ***F02B 63/04*** | (2006.01) |
| ***F02D 29/06*** | (2006.01) |

(52) U.S. Cl.

CPC ..... *E04B 1/34331* (2013.01); *B65D 88/022* (2013.01); *B65D 88/121* (2013.01); *E04B 1/34384* (2013.01); *E04H 1/1238* (2013.01); *F01N 3/0205* (2013.01); *F02B 63/04* (2013.01); *F02B 63/044* (2013.01); *F02D 29/06* (2013.01); *E04H 2001/1283* (2013.01)

(58) Field of Classification Search

CPC .. E04B 1/34331; F01N 3/0205; B65D 99/022; B65D 88/121; F02D 29/06; F02B 63/04; E04H 1/1238; E04H 2001/1283

See application file for complete search history.

(56) References Cited

U.S. PATENT DOCUMENTS

| | | | | | |
|---|---|---|---|---|---|
| 3,602,730 | A * | 8/1971 | Cushing | B63J 3/04 | 114/72 |
| 3,925,679 | A * | 12/1975 | Berman | E04B 1/3483 | 290/1 R |
| 4,503,337 | A * | 3/1985 | Häfner et al. | F02B 63/04 | 290/1 A |
| 4,657,290 | A * | 4/1987 | Linden | F02B 63/04 | 290/2 |
| 4,992,669 | A * | 2/1991 | Parmley | F01B 1/12 | 123/2 |
| 5,244,579 | A * | 9/1993 | Horner | B01D 61/022 | 210/195.2 |

(Continued)

FOREIGN PATENT DOCUMENTS

| | | |
|---|---|---|
| GB | 2094848 | 9/1982 |
| JP | 2007-332800 | 12/2007 |
| WO | WO 96/30601 | 10/1996 |

OTHER PUBLICATIONS

European Search Report dated Jul. 25, 2014.

*Primary Examiner* — Joshua J Michener
*Assistant Examiner* — Alp Akbasli

(57) ABSTRACT

An assembly includes a combustion engine and a housing to protect an engine, wherein the housing has a first wall and the first wall has a container.

11 Claims, 3 Drawing Sheets

(56) References Cited

U.S. PATENT DOCUMENTS 5,739,675 A 4/1998 Green et al.
6,129,520 A * 10/2000 Cooper ..... B07B 1/00 241/81
6,155,747 A * 12/2000 Payne ..... B09B 3/00 405/129.55
6,601,542 B2 8/2003 Campion
6,662,563 B1 * 12/2003 Nordentoft ..... F02B 63/04 60/614
6,729,817 B1 * 5/2004 Fennell ..... B62D 33/04 280/423.1
6,893,487 B2 * 5/2005 Alger ..... B01D 46/10 55/385.1
7,278,273 B1 * 10/2007 Whitted ..... H05K 7/1497 361/690
7,793,467 B1 * 9/2010 Melton ..... E04H 5/04 52/173.3
7,978,460 B2 7/2011 Dykes
8,587,136 B2 * 11/2013 Williams ..... F01K 13/00 290/1 A
8,872,366 B2 * 10/2014 Campion ..... F02B 63/04 290/1 A
2007/0144805 A1 * 6/2007 German ..... B60P 1/6418 180/209
2008/0055846 A1 * 3/2008 Clidaras ..... G06F 1/20 361/679.41
2008/0142197 A1 * 6/2008 Van Andel ..... A01G 9/246 165/122
2009/0188254 A1 * 7/2009 Osman ..... F28B 9/00 60/670
2009/0229194 A1 * 9/2009 Armillas ..... E04H 1/1205 52/79.1
2009/0241578 A1 * 10/2009 Carlson ..... F25D 17/06 62/259.2
2010/0021272 A1 * 1/2010 Ward ..... B65G 63/004 414/137.1
2010/0043264 A1 * 2/2010 Johnson, Jr. ..... G06Q 30/02 40/559
2010/0072757 A1 * 3/2010 Kealy ..... F01N 13/04 290/1 A
2010/0110626 A1 * 5/2010 Schmitt ..... H05K 7/20745 361/679.47
2010/0112925 A1 * 5/2010 Schmitt ..... H05K 7/20745 454/184
2010/0114356 A1 * 5/2010 Schmitt ..... G06F 1/20 700/117
2010/0170277 A1 * 7/2010 Schmitt ..... H05K 7/20745 62/259.2
2010/0243228 A1 * 9/2010 Price ..... F23J 15/06 165/185
2010/0301672 A1 * 12/2010 Di Cristofaro ..... H02B 1/52 307/39
2011/0049992 A1 * 3/2011 Sant'Anselmo ..... F03D 1/005 307/64
2011/0221573 A1 * 9/2011 Huat ..... G06Q 10/00 340/10.1
2012/0102929 A1 * 5/2012 Beissler ..... F01N 13/00 60/297
2012/0255734 A1 * 10/2012 Coli ..... E21B 43/26 166/305.1
2013/0118948 A1 * 5/2013 Noyes ..... G01N 23/223 206/569
2013/0269735 A1 * 10/2013 Roetzel ..... E21B 21/062 134/40
2014/0008359 A1 1/2014 Ferren
2014/0210214 A1 * 7/2014 Campion ..... F02B 63/04 290/1 A
2014/0263860 A1 * 9/2014 Iden ..... B61C 17/12 246/187 A
2014/0283452 A1 * 9/2014 Dittman ..... A01G 31/06 47/62 R

* cited by examiner

ASSEMBLY COMPRISING AN ENGINE

This application claims the benefit of priority of European Patent Application No. 14000636.2, filed Feb. 24, 2014, which is incorporated herein in its entirety by reference.

TECHNICAL FIELD

The present invention refers to an assembly comprising an engine.

BACKGROUND

Currently a stationary internal combustion engine is shipped in a container to a distant location. At the destination site the engine is removed from the container and is placed in a building, where the engine may be attached to a generator. The container will be removed from the site and can be used to transport other engines.

It is also known in the art to assemble a unit comprising an engine, a generator, and supporting devices like a cooler. The unit is placed in a container, so that the container may be used to transport the unit and to house the unit at the destination site.

SUMMARY OF THE INVENTION

In one aspect, the present disclosure is directed to an assembly comprising an engine and a housing to protect the engine, wherein the housing has a first wall and the first wall further comprises a container.

In another aspect, the present disclosure is directed to a method setting up an assembly, the method comprising: placing two or more containers to create an empty space surrounded by the containers; placing an engine in the space; and placing a roof on top of the containers to shield the engine.

In yet another aspect, the present disclosure is directed to a power plant comprising at least two assemblies, each assembly including an engine and a housing to protect the engine, wherein the housing includes a first wall and the first wall further includes a container.

DETAILED DESCRIPTION

Figure 1:
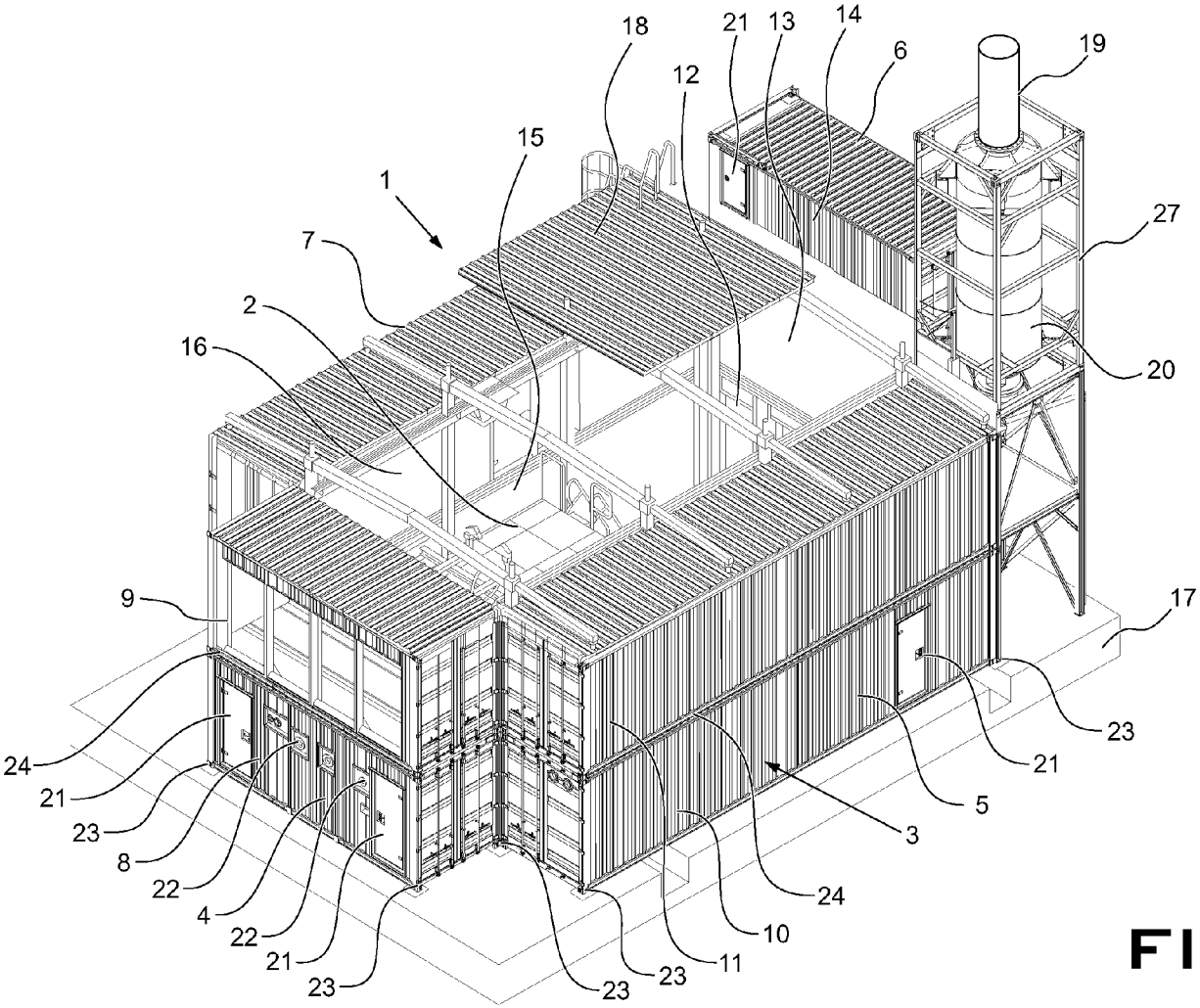
FIG. 1 shows an assembly.

FIG. 1 shows an assembly 1 comprising an engine 2 (not shown in FIG. 1) and a housing 3. The engine 2 may be a stationary combustion engine, particularly a stationary combustion gas-type engine, connected with a generator to produce electric power. The engine 2 and the generator are located inside the housing 3. The housing 3 has a first wall 4, a second wall 5, a third wall 6, and a fourth wall 7. The first wall 4 may be parallel to the third wall 6, and normal to the second wall 5 and the fourth wall 7. The walls 4, 5, 6, and 7 may form a generally square or rectangular arrangement in which the engine 2 is located. The first wall 4, second wall 5, and fourth wall 7 may each consist of two containers, namely, the containers 8 and 9, 10 and 11, 15 and 16, respectively. The containers 9, 11, and 16 are placed on top of the containers 8, 10, and 15, respectively. The third wall 6 may consist of three containers, namely the containers 12, 13, and 14, stacked from the bottom to the top, respectively. The containers 8, 9, 10, 11, 12, 13, 14, 15, and 16 may be detachably connected to each other by bolts, screws, locks, turning locks, angle plates, etc. Furthermore, the lower containers 8, 10, 12, 15 may be placed on a foundation, such as a ground plate 17 made of concrete.

The lower containers 8, 10, 12, and 15 may be placed on leveled bottom plates, which may be positioned on the foundation at the lower corners of the lower containers. Four or more leveled bottom plates may be used per container.

Between the upper and the lower containers a shield to reduce the transmission of noise, heat, or the both may be installed. This shield may be made of foam material.

On top of the upper containers 11 and 16, a roof 18 may be placed, which covers the inner space of the housing 3 formed by the containers 8, 9, 10, 11, 12, 13, 14, 15, and 16. A chimney 19 may be attached to the housing 3 and connected to the exhaust system of the engine 2. The chimney 19 may include an exhaust silencer 20 to reduce the operating noise of the assembly 1.

The chimney 19 and the exhaust silencer 20 may be attached to a rack 27, which has the dimensions of an ISO container. An ISO container may have a length of 6.095 m, a width of 2.352 m, and a height of 2.393 m, and could be called a 20-ft container. Alternatively, the ISO container may have a length of 12.032 m, a width of 2.352 m, and a height of 2.393 m, and may be called a 40-ft container. An ISO container could also have a length of 12.032 m, a width of 2.352 m, and a height of 2.698 m.

The chimney 19 and the exhaust silencer 20 may be at least partially surrounded by the rack 27.

The containers 8, 9, 10, 11, 12, 13, 14, 15, and 16 may include doors 21 to allow entrance to the containers and to provide access to the interior of the assembly 1. Also, the containers 8, 9, 10, 11, 12, 13, 14, 15, and 16 may include windows 22 to allow light to enter the containers.

The containers 8, 9, 12, 13, and 14, forming the first wall 4 and the third wall 6, may be ISO 20-ft containers. The containers 10, 11, 15, and 16, forming the second wall 5 and the fourth wall 7, may be ISO 40-ft containers.

The container 8 may contain a gas train, and an intercooling circuit and its connections.

The container 9 may contain installations, such as fans, filters, and openings to transport air from the inside of the assembly to the outside.

The container 10 may be an auxiliary container containing an engine-cooling system and a lube-oil-cooling system. Each of the engine-cooling system and the lube-oil-cooling system may include a heat exchanger. Moreover, an engine-control system and an auxiliary control system may be installed in the container 10.

The container 11 may be an exhaust container. An exhaust-heat exchanger and a catalyzer may be inside of the exhaust container 11.

The containers 12, 13, and 14 may each house an inlet-air system including fans and air filters to supply air to the inner space of the assembly, and the engine in particular.

The container 15 may contain control units to supply pressurized air to the assembly.

The container 16 may be a medium-voltage container, housing at least one transformer to provide the assembly 1 with medium-voltage electricity. Furthermore, the container 16 may include a medium-voltage control unit to control the medium-voltage power supply. Medium voltage may be used to power the engine-cooling system and the lube-oil-cooling system.

Figure 2:
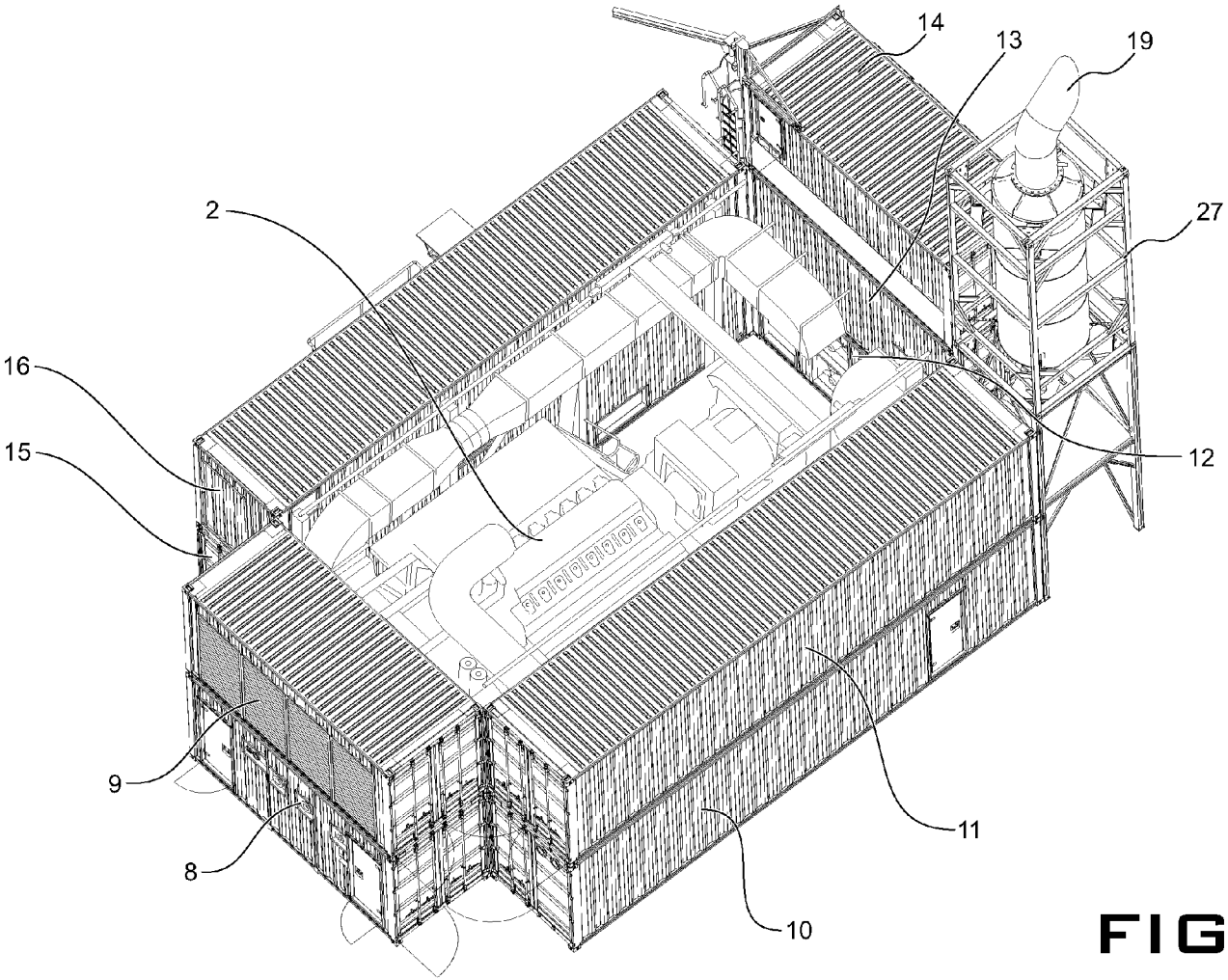
FIG. 2 shows an assembly with an engine.

FIG. 2 shows an assembly 1 housing an engine 2 and a generator 25 (not labeled in FIG. 2). The engine 2 is placed in an area which is defined by the containers 8, 9, 10, 11, 12, 13, 14, 15, and 16. The engine 2 is directed along the main axis of the housing. The generator 25 is connected to the engine 2, so that the engine 2 can drive the generator 25.

Figure 3:
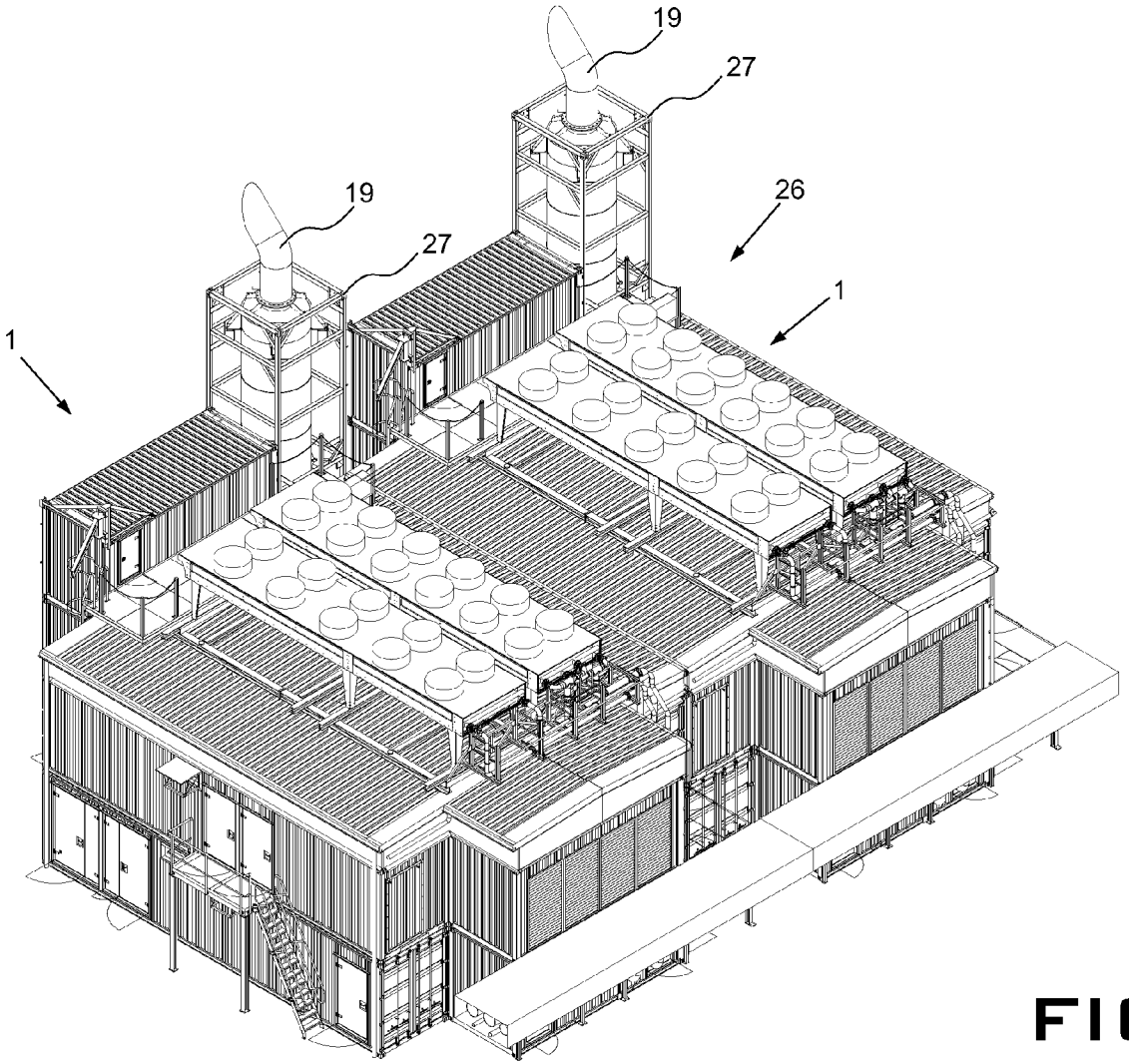
FIG. 3 shows a power plant comprising two assemblies.

FIG. 3 shows a power plant 26, which comprises two assemblies 1. The assemblies 1 are placed next to each other and may be connected by wires, bolts, etc. The main control unit of the power plant 26 may be located in one of the assemblies and connected to the engine of the other assembly 1.

INDUSTRIAL APPLICABILITY

In the following the method of setting up the assembly will be described. The assembly may be pre-assembled for transportation at an assembly site. Referring to FIG. 1, at the assembly site, a gas train and an inter-cooling circuit are pre-installed in the container 8. Pumps, filters, and control units to transport air from the inside of the assembly to the outside are pre-installed in the container 9. A heat exchanger and an auxiliary control system may be pre-installed in the container 10. A catalyzer and an exhaust-heat exchanger may be pre-installed in the container 11. Devices supplying air to the inner space of the assembly may be pre-installed in the containers 12, 13, and 14. Devices supplying pressured air and associated control units may be pre-installed in the container 15. Transformers to transform electric power to medium voltage and a medium-voltage control unit may be pre-installed in container 16.

Furthermore, the engine, the generator, desk-coolers, pipes, working platforms, and supporting structures may be stored in one or more containers for transportation.

At a destination site, bottom plates 23 may be placed on a foundation 17. The foundation 17 may be made of concrete. The bottom plates 23 may be leveled out. The bottom plates 23 may support the containers to keep the containers in horizontal surfaces.

The bottom containers 8, 10, and 15 may be placed on the bottom plates 23 one after another. The containers may be connected by angle plates, which are fixed to the containers by screws. The containers 8, 10, and 15 may be arranged in a U-shape, whereby the container 10 and the container 15 respectively may form the legs of the U-shape and the container 8 may be located between the containers 10 and 15. The container 8, 10, and 15 may define three sides of the inner space of the assembly. Shields may be placed on top of the bottom containers 8, 10 and 15 to insulate noise, heat, or the both. The container 9, 11, and 16 are placed on top of the containers 8, 10, and 15, respectively. The top containers 9, 11, and 16 may be connected to the bottom containers 8, 10, and 15 using twist locks. On top of the containers 11 and 16 a roof may be placed, which spans the inner space of the assembly. Supporting structures and working platforms may be installed in the inner space of the assembly. The engine and the generator may be assembled, connected, and put into the inner space of the assembly.

The devices and systems located in different containers may be connected with flexible pipes. Electric wires may be set up between the containers to connect electric components in different containers.

The containers 12, 13, and 14 may be placed at the open end of the U-shape to close the open end. Silencers and exhaust pipes may be placed in the containers 12, 13, and 14.

The invention claimed is:

1. A method of setting up an assembly, the method comprising:

placing a plurality of ISO containers to create an inner space surrounded by the ISO containers, the inner space defined by a plurality of walls, wherein each of the plurality of walls is formed at least in part by a different one of the plurality of ISO containers;

placing an engine in the inner space such that the engine is housed within the inner space defined between outside walls of the plurality of ISO containers and wherein the engine is not housed within any of the plurality of ISO containers or within a building located within the inner space; and placing a roof covering the inner space defined between the plurality of ISO containers to shield the engine contained within the inner space.

2. An assembly comprising an engine and a housing to protect the engine, wherein the housing includes an inner space defined by a plurality of walls, wherein each of the plurality of walls is formed at least in part by a different one of a plurality of ISO containers, and wherein the engine is housed within the inner space defined between outside walls of the plurality of ISO containers, wherein the housing comprises a roof, which covers the inner space defined between the plurality of ISO containers and wherein the engine is not housed within any of the plurality of ISO containers or within a building located within the inner space.

3. The assembly of claim 2, wherein at least one of the plurality of standardized shipping containers has a length of at least 20 ft.

4. The assembly of claim 2, wherein at least one of the plurality of standardized shipping containers has a length of longer than or equal to 40 ft.

5. The assembly of claim 2, wherein a first wall of the plurality of walls comprises an upper container and a lower container, the upper container being stacked on top of the lower container.

6. The assembly of claim 5, wherein the upper container has the same length, width, and depth as the lower container.

7. The assembly of claim 2, wherein at least a first container of the plurality of ISO containers contains a heat exchanger connected with an exhaust pipe of the engine.

8. The assembly of claim 2, wherein at least a first container of the plurality of ISO containers contains a control unit configured to control the engine.

9. The assembly of claim 2, wherein at least a first container of the plurality of ISO containers contains a transformer to transform electric voltage.

10. The assembly of claim 2, wherein the assembly comprises a chimney with a rack, the rack having the size of an ISO container.

11. A power plant comprising at least two assemblies, each assembly comprising an engine and a housing to protect the engine, wherein the housing includes an inner space defined by a plurality of walls, wherein each of the plurality of walls is formed at least in part by a different one of a plurality of ISO containers, wherein the engine is housed within the inner space defined between the plurality of ISO containers such that the engine is housed within the inner space defined between outside walls of the plurality of ISO containers, a roof covers the inner space defined between the plurality of ISO containers to shield the engine contained within the inner space, and wherein the engine is not housed within any of the plurality of ISO containers or within a building located within the inner space.

* * * * *